US006682063B2

(12) United States Patent
Niedermeyer

(10) Patent No.: US 6,682,063 B2
(45) Date of Patent: Jan. 27, 2004

(54) FOLDING APPARATUS FOR NAPKIN STACKS HAVING TWO-COLOR SEQUENCES

(76) Inventor: William P. Niedermeyer, 1024 Mt. Mary Dr., Green Bay, WI (US) 54311

( * ) Notice: Subject to any disclaimer, the term of this patent is extended or adjusted under 35 U.S.C. 154(b) by 101 days.

(21) Appl. No.: 10/122,356

(22) Filed: Apr. 15, 2002

(65) Prior Publication Data

US 2003/0197322 A1 Oct. 23, 2003

(51) Int. Cl.[7] ..... B31B 1/34; B41L 43/00

(52) U.S. Cl. ..... 270/32; 270/42; 493/359; 493/231; 83/937

(58) Field of Search ..... 270/32, 41, 42; 493/123, 231, 356–360, 442, 444; 83/94, 937

(56) References Cited

U.S. PATENT DOCUMENTS 4,279,410 A * 7/1981 Bolza-Schunemann ..... 270/6
4,349,185 A * 9/1982 Small et al. ..... 270/32
4,360,194 A * 11/1982 Bradley ..... 270/51
4,475,730 A * 10/1984 Trogan ..... 270/41
5,088,975 A * 2/1992 Ghilardi ..... 493/359
6,375,605 B1 * 4/2002 Niedermeyer ..... 493/359

* cited by examiner

*Primary Examiner*—Christopher P. Ellis
*Assistant Examiner*—Mark A. Deuble

(57) ABSTRACT

Dual folding apparatus using multi-width parent rolls to produce color sequenced stacks of napkins, including means for unwinding, slitting and advancing same-color product webs to a turning and lane separating device to selectively transfer first-color webs to one of two 'folding' lanes and selectively transfer second-color webs to the other lane. First and second-color webs in superposed side by side advancement are embossed, and webs of the same color are directed to one side of a dual folder for longitudinal folding, cutoff, and transverse folding while the second-color web is processed in the other side of the dual folder. Napkins of one color are superposed on napkins of a second color and delivered as a pair between delivery belts for packout into stacks having napkins of alternating color. Two adjacent delivery lanes deliver stacks of the same mixed colors. In machines with four delivery lanes, first and second lanes can have alternating first and second colors, while the the third and fourth lanes can have alternating third and fourth color stacks. Other embodiments include different placement of unwind stands, arrangement of parent roll colors, and other turning and lane changing means.

16 Claims, 7 Drawing Sheets

A2 B2
A1 B1

FOLDING APPARATUS FOR NAPKIN STACKS HAVING TWO-COLOR SEQUENCES

BACKGROUND AND SUMMARY OF THE INVENTION

This invention relates to folding apparatus, and more particularly, napkin folders to make product stacks having a two color sequence in each stack.

The invention is useful as applied to 'dual folders, a well known face-to face arrangement of two single folders to double production of 1-ply semi-crepe napkins for consumer and commercial use.

Introduced in the 1940's as a two wide machine with two delivery lanes, they were subsequently widened to three and four delivery lanes as paper machine widths increased.

Use of recycled fiber and wider webs dictated that most current folders are four wide for lowest cost production, but all prior art folders using two wide parent rolls deliver only one color stacks since the two wide parent roll webs are processed full width and slit just before they are longitudinally folded.

In current folders similar to the apparatus described in U.S. Patent of Small U.S. Pat. No. 4,349,185, parallel webs of the same color are advanced to adjacent folding plates as two separate but identical webs of the same color for transverse folding in each side of a dual follder before they are brought back together for delivery between belts as a supeposed pair of similarly colored napkins.

In the instant invention, parent rolls webs are slit into two product width webs before advancing to a turning and lane changing device where different colored webs are advanced to each pair of four coacting folding plates and transversly folded for delivery in four lanes.

The apparatus of this invention can produce two delivery lanes of alternatiely colored napkins from a two wide machine, a two color mixed stack and a single color stack from a three wide machine, or alternating colors in two or four lanes of a four wide machine An objective of the invention is to achieve color mixing in stacks for a choice of unwind roll locations for the most efficient material handling of new supply rolls and delivered stacks.

Another object is to achieve color mixing utilizing current folder apparatus having only one knife-anvil roll pair cooperating with each single folder of the dual arrangement.

A further object is to describe apparatus to compensate for transverse web growth in each of two adjacent product webs being embossed with provision to deliver folded webs with equal panels from the longitudinal folding plates.

Other advantages and objects of the invention may be seen in the ensuing specification.

DETAILED DESCRIPTION

Figure 1:
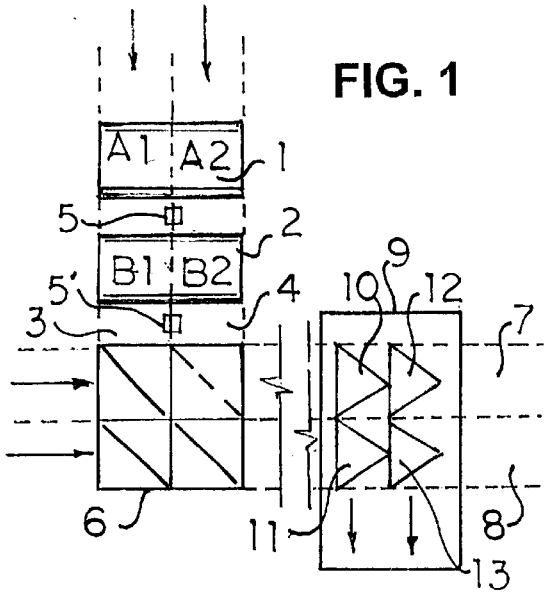
FIG. 1 is a plan view schematic illustrating a pair of supply rolls arranged on one side of two parallel folding plate lanes, a turning device, and downstream folding plates for a dual folder (not shown).

In FIG. 1, supply roll 1 of color A comprising two product webs A1 and A2 passes through slitter 5 and advances along infeed paths 3 and 4 respectively.

Supply roll 2 of color B comprising two product webs B1 and B2 is slit at 5' and advances along infeed paths 3 and 4 respectively.

The slit product webs enter turning/lane interchange device 6 and exit along folding paths 7 and 8 for subsequent fabricating steps and delivery in stacks.

Since two supply rolls involve two product webs of each color (4 total webs), color mixing requires two supply rolls, fout slit product webs and four longitudinal folding plates 10–13 for delivery as napkin pairs of alternating color from two delivery lanes of folding apparatus.

Figure 8:
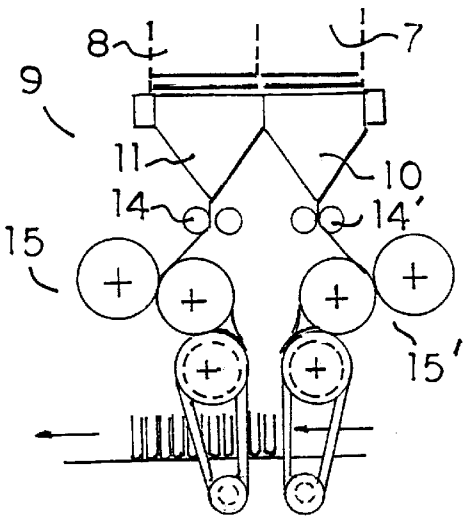
FIG. 8 is an end view of two single folders arranged face to face as a dual folder.

Referring to FIG. 8, the bottom web in lane 7 is longitudinally folded by plate 10, and the bottom web in lane 8 is longitudinally folded by plate 11. The folded webs are advanced over folding pastes by pull rolls 14, 14' and advanced for transverse folding in folders 15 and 15' of dual folder 9.

Figure 5:
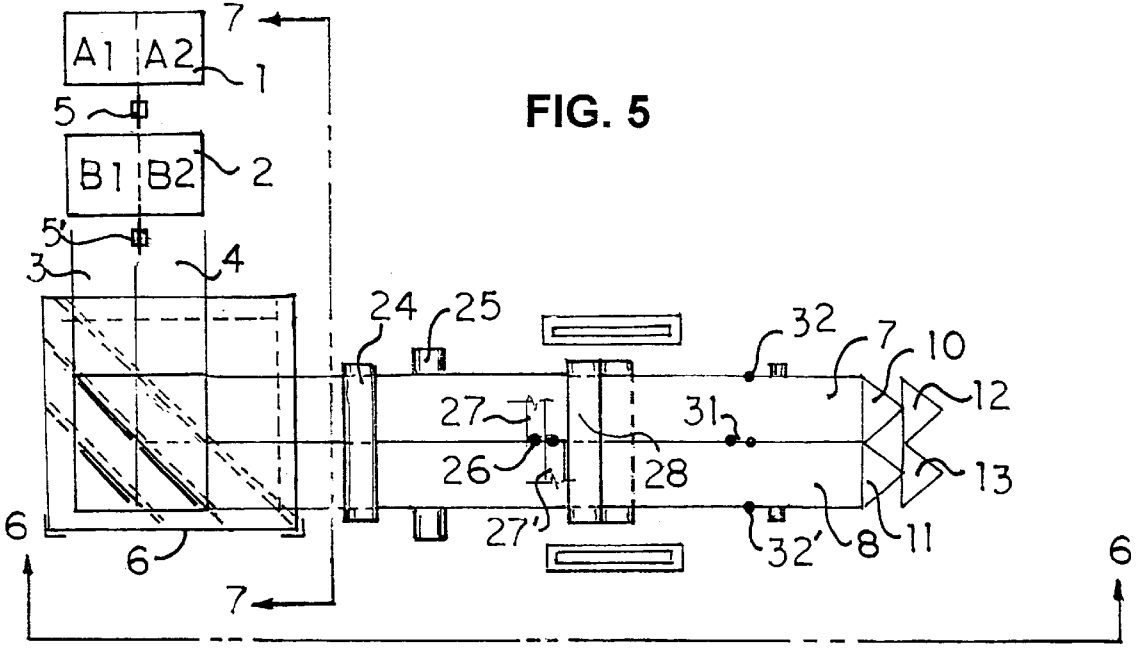
FIG. 5 is a plan view schematic similar to FIG. 1 illustrating web draw rolls, spreader roll before embossing, embosser and folding plates for a dual folder.

Referring again to FIG. 1, the selected turning bar arrangement shown is enlarged and detailed in FIG. 5.

Figure 2:
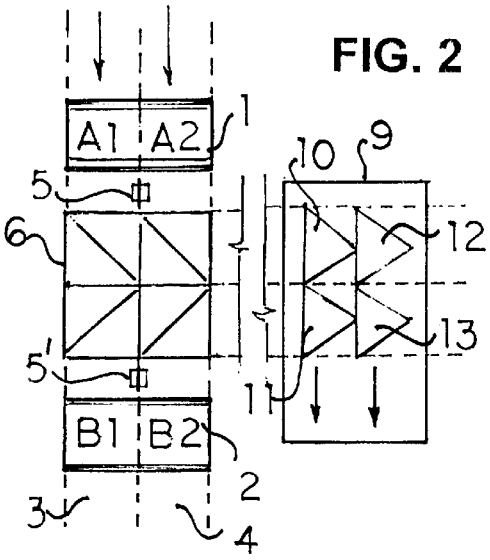
FIG. 2 is a plan view schematic illustrating a pair of rolls, one on each side of the two folding lanes with associated components.

In FIG. 2, supply roll 1 for webs A1, A2 and supply roll 2 for B1, B2 are on opposite sides of folding plate lanes 7, 8. The turning bars in turning/lane interchange device 6 are arranged to advance like colored webs A1, A2 to lane 7 and B1, B2 to lane 8, as more fully detailed in FIGS. 13–15 (see also FIG. 16A).

Figure 3:
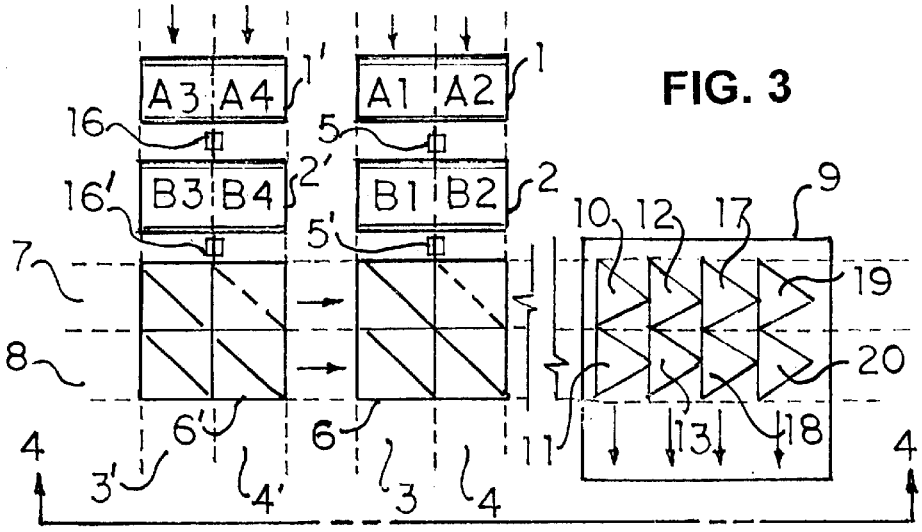
FIG. 3 is a plan view schematic for two pairs of supply rolls arranged on one side of the folding lanes, with two tiers of turning devices arranged for serial processing of each pair of rolls and advancing 8 webs to a four wide folding apparatus.

In FIG. 3, supply roll 1 is comprised of webs A1, A2, supply roll 1' for A3, A4 of the same color, and rolls 2, 2' for different color webs B1, B2, B3 and B4 respectively are all on one side of the folding plate lanes 7 and 8.

Slitters 5, 5' produce four product webs for turning in apparatus 6, and slitters 16, 16' produce four product webs for turning in apparatus 6'.

Slit webs are advanced by draw rolls 24 (see FIG. 5) for subsequent embossing (not shown), and longitudinal folding by plates 10–13 and 17–20 before transverse folding in folders 15, 15' (shown in FIG. 8).

Figures 13, 14, 15:
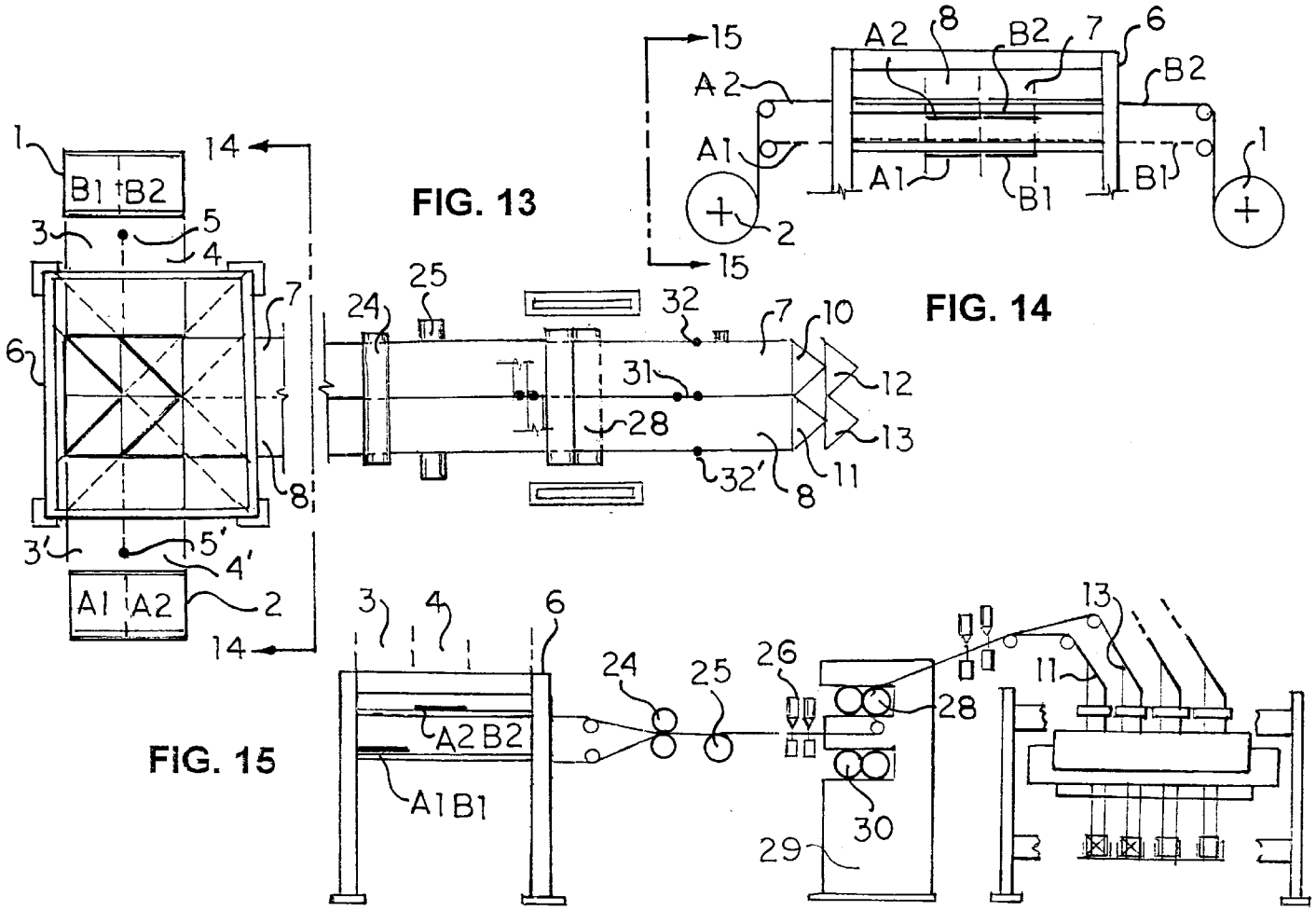
FIG. 13 is a plan view schematic for supply rolls arranged on both sides of the folding lane paths illustrating bar arrangement to place two like colored webs in each lane, noting the bar extensions beyond outside margins of both incoming and exiting webs.
FIG. 14 is a side elevation viewed from 14—14 of FIG. 13.
FIG. 15 is a side elevation viewed from 15—15 of FIG. 14 illustrating double turning bar and web threadup for embossing two superposed adjacent web pairs comprising four product webs.
Figures 17, 18, 19, 20:
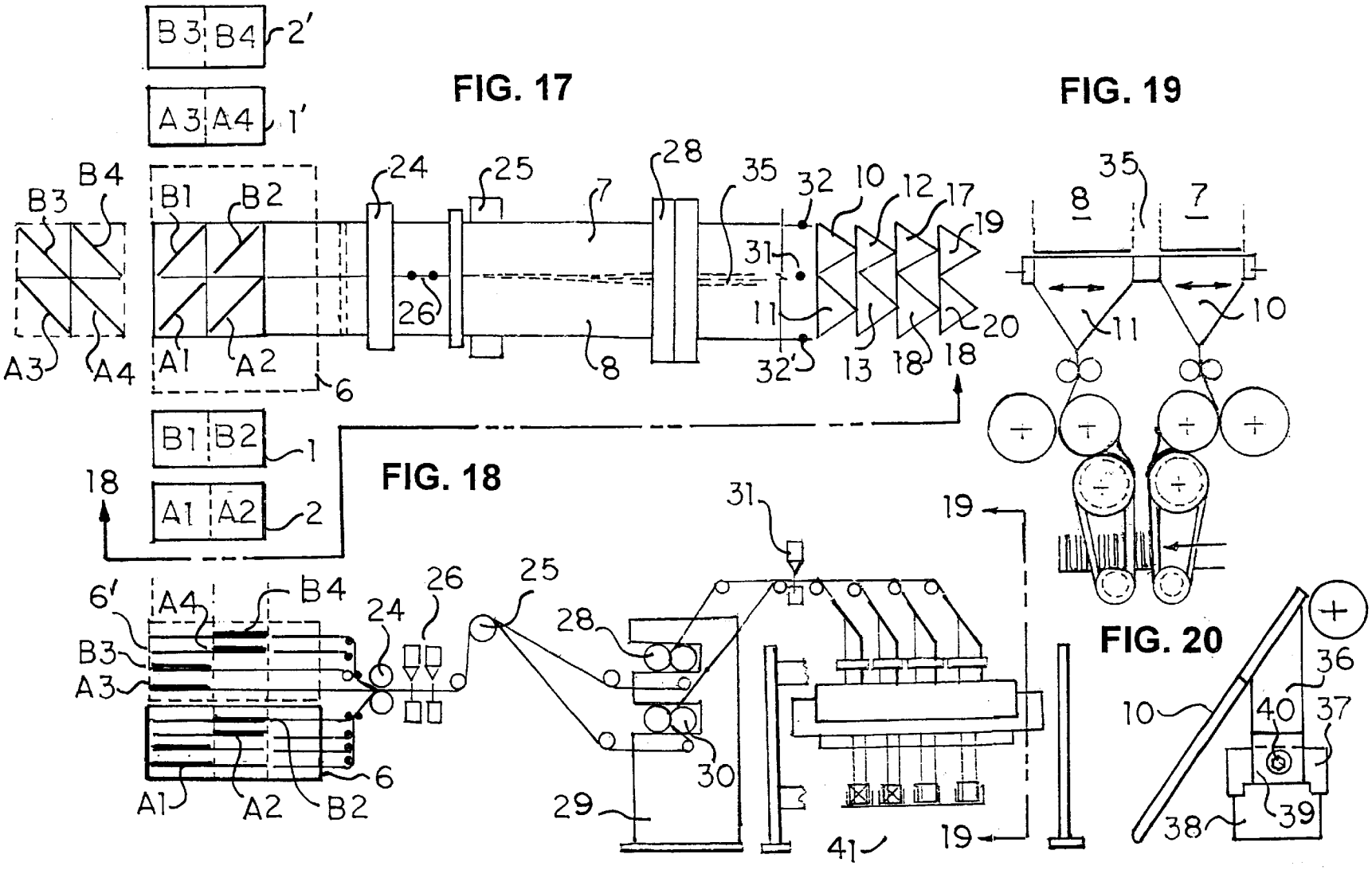
FIG. 17 is a plan view schematic for two supply rolls on both sides of the folding lane path illustrating two superposed tiers of turning bars for color mixing and embossing of two plies (4 product webs) in the upper set of embossing rolls and 2 plies (4 webs) in the lower set for subsequent separation of adjacent webs for placement on one of two adjacent folding plates.
FIG. 18 is a side elevation schematic viewed from 18—18 of FIG. 17 illustrating the processing means of FIG. 17 including one side of the dual folder.
FIG. 19 is an end view of two single folders in side by side dual folder arrangement illustrating selective separation of folding plates.
FIG. 20 is a side elevation schematic of a folding plate side shift mechanism viewed from 20—20 of FIG. 19.

In FIGS. 1–4, 11A–11C. 12A–12C and 16A–16E, only the active surface of turning bars are shown for clarity, however, in FIGS. 5, 13 and 17, the framework for supporting bars extend beyond the active surfaces because turning bars must clear the outer margins of incoming and exiting web paths. For example, in FIG. 5, the framework must exceed 3 product widths on both infeeds and exit sides to avoid web interference with bar end supports within the active zones.

Figure 4:
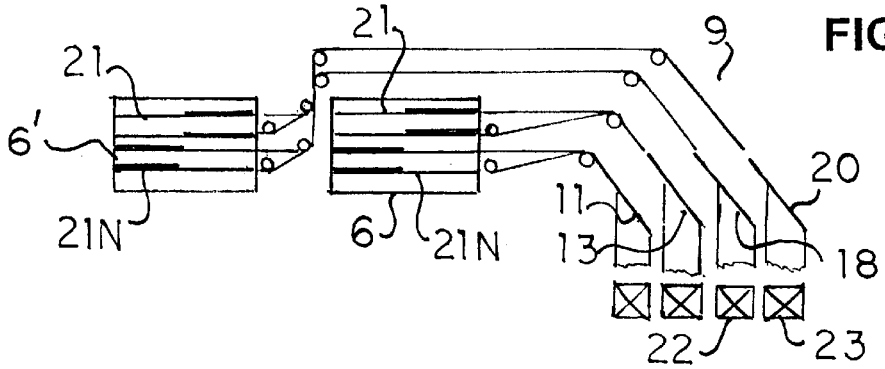
FIG. 4 is a side elevation schematic viewed from sightline 4—4 of FIG. 3

In FIG. 4, a tier 6' of four spaced turning bars 21–21*n* receive and turn webs from supply rolls 1', 2' which bypass tier 6 for advancement to folding plates 17, 18 and 19, 20 for subsequent transverse folding and delivery in lanes 22 and 23 of dual folder 9.

Figure 11A:
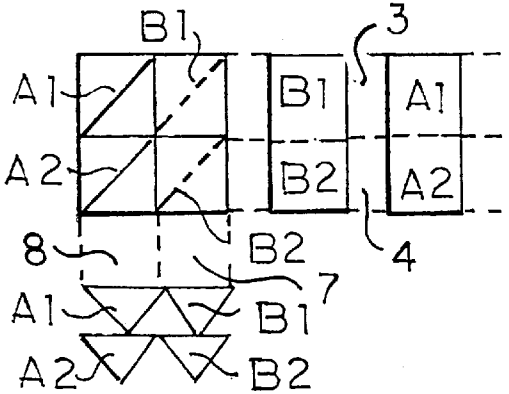
FIG. 11A is a plan view of the turning device in FIGS. 1 and 9 illustrating placement of two colored webs from the same supply roll in the same folding lane.
Figure 11B:
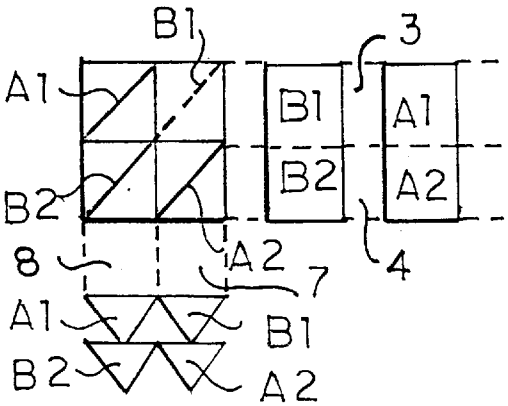
FIG. 11B is a plan view like FIG. 11A illustrating turning bar arrangement for placement of alternately colored webs in the same lane for color mixing of different colors from adjacent folding plates.
Figure 11C:
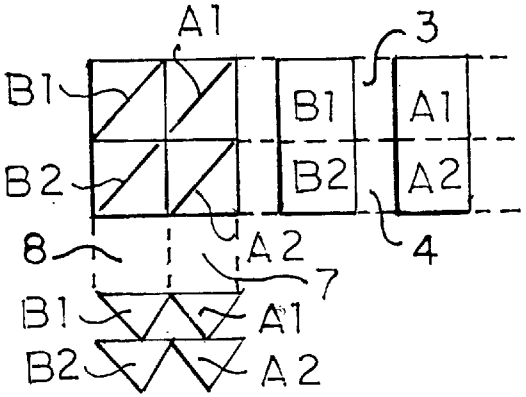
FIG. 11C is a similar plan view illustrating a bar arrangement to place similarly colored webs in the same folding lane path opposite from FIG. 11A.

The turning bar arrangements of FIGS. 1, 5, and 11A–11C are identical and FIGS. 11A–11C describe different web paths including lane interchanges from 7 to 8 or vice versa.

Different web paths are made possibe by providing vertical spacing between each turning bar to insure that moving web surfaces travelling in different directions do not make contact.

Webs advancing in opposite directions or moving perpendicular to each other must be separated, whereas webs travelling in the same direction can use the same turning bar and be in superposed surface contact after turning 90 degrees into exit lanes 7, 8.

In FIG. 5, webs are pulled from turning bar aparatus 6 by draw roll pair 24. A pair of co-acting water jet cutters 25 are mounted for transverse adjustment on supports 26, 26.' to slit variable width trim from the center of adjacent webs to create a gap between webs for advancement to upper embosser roll set 27 supported in frame 28.

Figure 6:
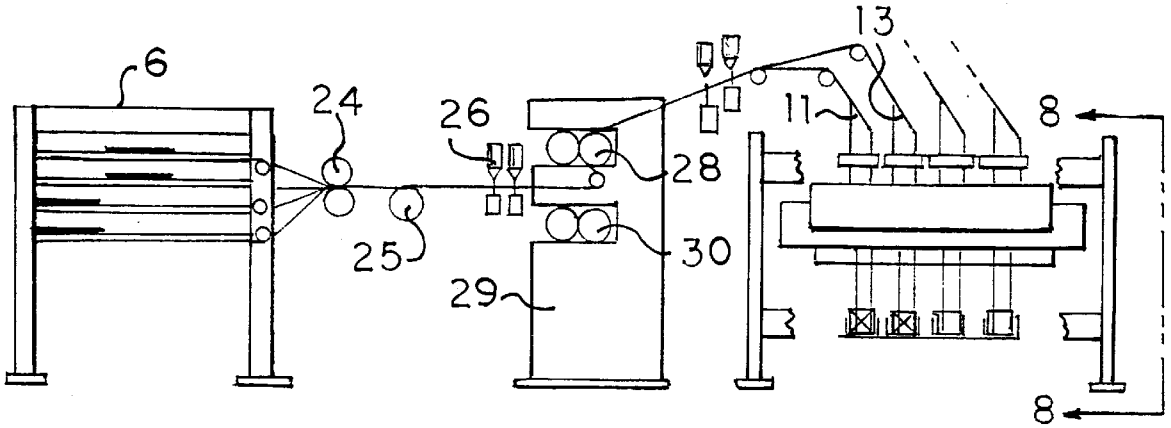
FIG. 6 is a side elevation schematic viewed from 6—6 of FIG. 5.

In FIGS. 5 and 6, four product webs are processed simultaneously through exit draw rolls 24 as two superposed adjacent webs advancing in parallel lanes 7, 8 (two superposed webs per lane) for embossing, folding and delivery.

Prior to embossing, center trim is slit by water jet cutters 26 and removed (trim suction fan not shown) to create a gap so that growth through the emboss roll set does not result in overlap of adjacent webs.

Ex-embosser, transverse web growth beyond target web width over folding plates is trimmed by center jets 31 and edge jets 32, 32'.

Figure 7:
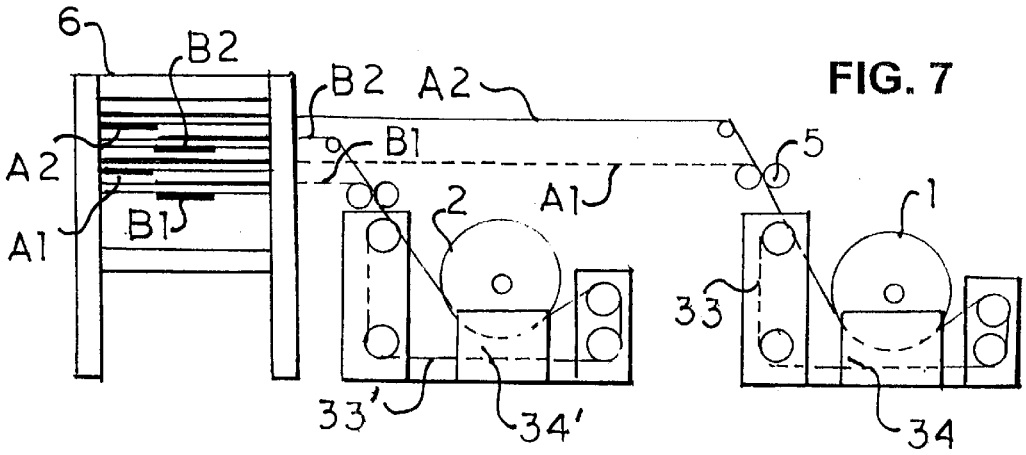
FIG. 7 is a side elevation schematic illustrating two supply rolls with slitting means to produce four product webs with exiting web positions from the turning device.

In FIG. 7, dupply rolls 1, 2 are unwound by belts 32, 32' in roll inwind stands 33–33', slit as at 5, 5' and advanced to turning device 6 having framework exceeding three product widths to avoid bar mounting interference with incoming or exiting webs.

Figure 9:
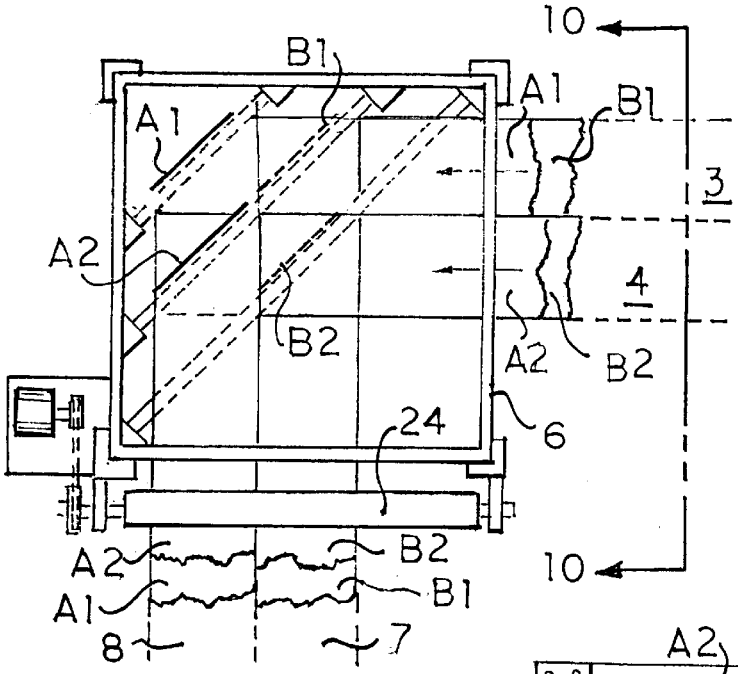
FIG. 9 is an enlarged plan view schematic of the web turning device illustrating incoming and exiting webs, turning device framework and extension of bars beyond the outside margins of juxtaposed webs

In FIG. 9, incoming webs A1, B1, advance from infeed path 3 and webs A2, B2, advance from path 4.

Webs A1, A2 advance to opposite lane 8 above webs B1, B2 which are directed to lane 7.

Webs A1, B1 are on the bottom in parallel lanes and webs A2, B2, are superposed.

In FIG. 11, this arrangement results in different colored webs A1, B1 being longitudinally folded over plate pair 10, 11 (see FIGS. 5, 6, and 8).

Figure 10:
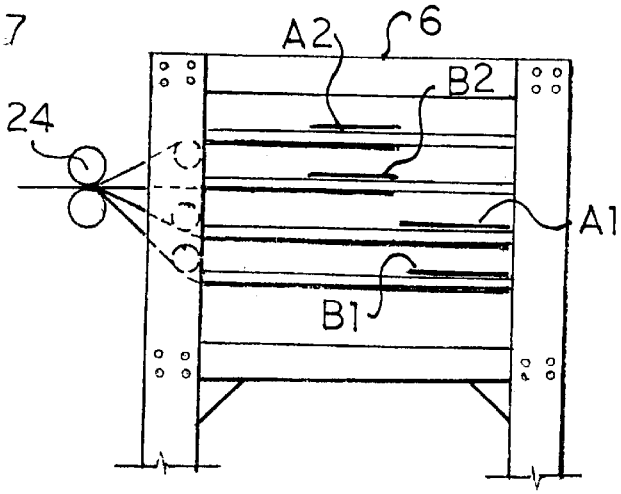
FIG. 10 is a side elevation from sightline 10—10 of FIG. 9 illustrating incoming web positions over separate turning bars and draw rolls for the pluraliuty of exiting webs.

In FIG. 10, the bar arrangement is viewed from the infeed side. After turning and proper lane orientation, the four webs (2 pair of adjacent webs) are superposed and pulled by draw rolls 24.

In FIG. 11A, like colors A1, A2 are folded over plate 11 and B1, B2 are folded over plate 10 (see FIG. 8).

In FIG. 11B, webs are threaded differently from 11A with web B2 interchangd with web A2.

In FIG. 11C, webs are threaded differently from 11B with web B1 interchanged with web A1.

In FIGS. 11A–11C, two unwinds are on the same side of folding lanes 7, 8 (see also FIG. 1) and turning bars for all webs are parallel.

Figure 12A:
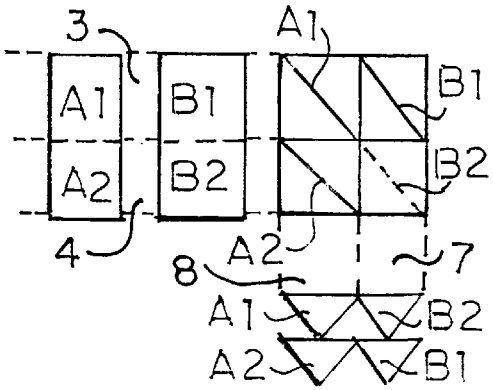
FIG. 12A is a similar plan view for two supply rolls located on the same side of folding lanes illustrating, like FIG. 11A, two webs from the same supply roll placed in the same folding lane path.
Figure 12B:
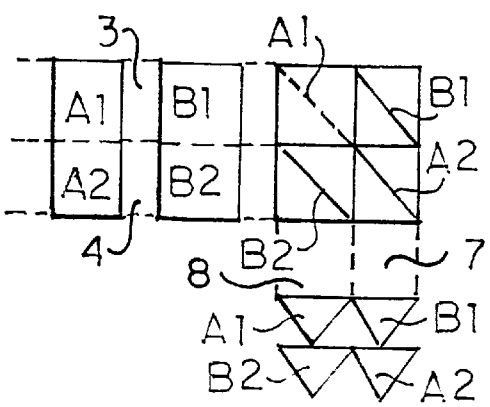
FIG. 12B is a plan view schematic similar to FIG. 12A illustrating a bar arrangement for placement of alternating colored webs in the same folding lane path for color mixing with different colors from adjacent folding plates.
Figure 12C:
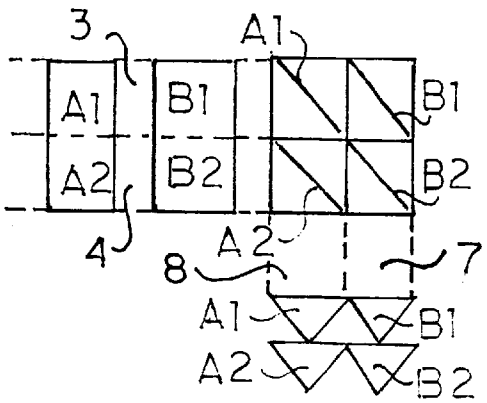
FIG. 12C is a similar plan view illustrating a bar arrangement to place similarly colored webs in the same folding lane path with webs superposed oppositely from the superpositions of FIG. 12A.

In FIGS. 12A–12C, two rolls are on the other side of folding plate paths 7, 8, are also parallel, and mirror image the turning bar arrangement of FIGS. 11A–11C.

In FIG. 13, supply rolls 1, 2, are on opposite sides of folding lanes 7, 8 and turning bars for each color are perpendicular.

In FIG. 13, water jet cutters 5, 5' are used to slit supply rolls into product webs Infeed web travel for adjacent product webs of the same color is parallel, and after turning, like colors are superposed in the same lane and exit from apparatus 6 in surface contacting relationship, A1, A2 in lane 8, B1, B2 in lane 7.

In FIG. 14, two spaced turning bars are used since different colored webs A1, B1 or A2 B2 are not in contact, but after turning, webs of the same color are in each lane for side by side longitudinasl folding and processing as a color mixed pair in the dual folder.

In FIG. 15, incoming webs advance in opposite directions. Bottom webs A1, B1, are shown dashed and occupy infeed lane 3, 3' respectively to advance to the first set of folding plates (see FIG. 16A).

Figure 16A:
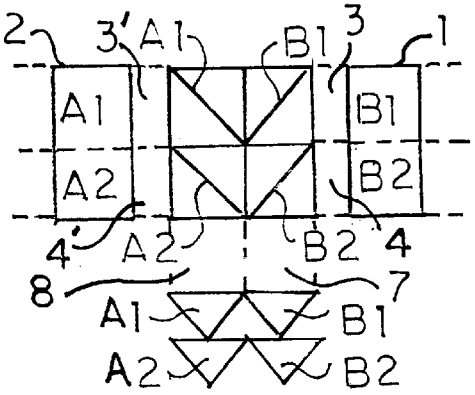
FIG. 16A is a plan view schematic of web travel from supply rolls on both sides of the folding lanes illustrating turning bars arranged to place similarly colored webs in the same lane.
Figure 16B:
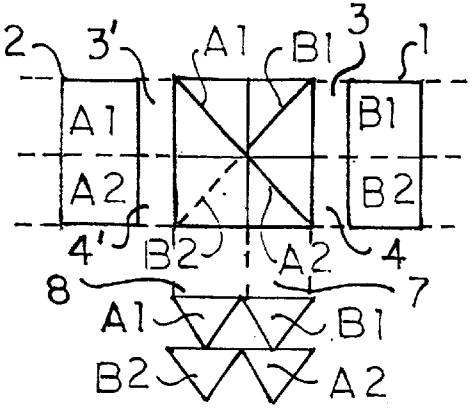
FIG. 16B is a plan view like FIG. 16A illustrating turning bars arranged to place different colored webs into the same lane for color mixing with oppositely colored webs in the second folding lane.
Figure 16C:
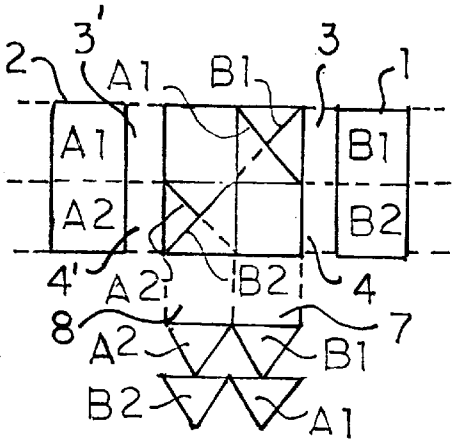
FIG. 16C is a plan view schematic like FIG. 16B with bars arranged to interchange webs of similar color to lanes opposite from FIG. 16B.
Figure 16D:
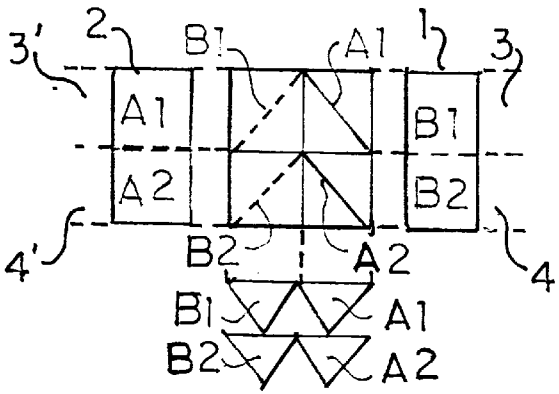
FIG. 16D is a plan view schematic like FIG. 16A with colors reversed from folding lanes in FIG. 16A.

FIGS. 16A and 16D have the same turning bar arrangement with webs in 16D interchanged to lanes opposite from FIG. 16A.

In FIG. 16B, webs A2, B2 interchange lanes from FIG. 16A.

When webs travel in opposite directions surface contact and web rupture are avoided by using four spaced bars rather than two bars in FIG. 11A.

Figure 16E:
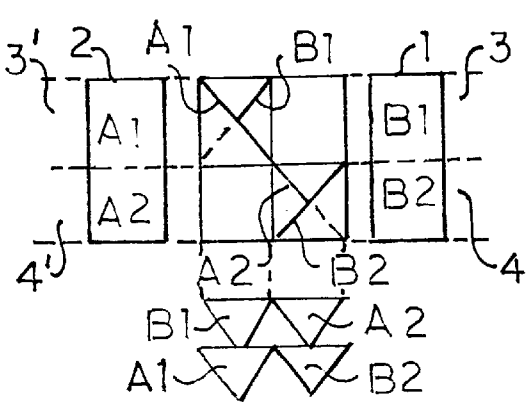
FIG. 16E is like FIG. 16A with colors reversed from the folding lane placement shown in FIG. 16C.

In FIGS. 16C and 16E, turning bars for one color are mounted perpendicular to bars for other colored webs.

In FIG. 16E, webs interchange folding lanes from the positions in FIG. 16C.

In FIG. 17, supply roll 1 of color ans supply roll 2 of color B are mounted on one side of folding lanes 7, 8. Rolls 1', 2', are installed on the opposite of folding lanes.

After slitting into product webs, each group of four webs is advanced to turning bars in tier 6 for webs from rolls 1, 2, and tier 6' for webs from rolls 1', 2' . . .

In FIG. 17, tier 6' is offset and shown dashed for clarity to indicate turning bar arrangement whereas FIG. 18 shows tier 6' in the proper orientation above tier 6.

In FIG. 18, both tiers have spaced turning bars to orient sequemtially different colored webs for each set of folding plates.

Bottom webs A1, B1, are folded over plates 10, 11, with the next bottom web pair A2, B2, folded over plates 12, 13, next bottom web A3, B3, over plated 17, 18 and the last web A4, B4, over plates 19, 20 (see FIG. 17 for plate sequence).

In FIG. 17, adjacent webs are water jet cut as at 26 to cut through overlapped webs and permit transverse web separation 35 by spreader roll 25.

Gap 35 occurs prior to embossing and permits transverse web expansion through embosser roll pairs 28, 30 without overlap.

Water jet cutters 31, 32, 32' are used to trim transverse web growqth from the center and edges of the adacent webs after embossing.

Jet cutter transverse locations are adjustable (not shown).

In FIG. 19, trim gap 35 can be adjusted by the amount of web spreading and adjustment of jet cutters. Final trimmed web width must be centered on each folding plate thus, plates are mounted for sideway adjustment.

In FIG. 20, plate 10 is fastened to plate support 36 which is part of slideable member 37 supported on cross piece 38.

Cross piece 38 a threaded hole in each of two screw supports on either side of the plate centerline for adjusting screws 40 and reverse threaded 40'. Screws bear against and move the slideable base 37 thus moving attached support 36 and plate 10.

It is understood that the present invention may be embodied in other specific forms without departing from the spirit or special attributes, and it is therefore, desired that the present embodiments be considered in all aspects as illustrative and, therefore, not restrictive, reference being made to the claims rather than to the foregoing specification to indicate the scope of the invention.

Having thus described the invention, what is desired to protect by Letters Patent are the following:

1. Apparatus for producing napkin stacks having a plurality of color sequences, comprising:

means to unwind a plurality of supply rolls for advancement along a plurality of first paths and a plurality of second paths perpendicular to said first path, each of said supply roll webs being monochromatic, of different color, and having a width of two product widths, means to slit each supply roll web into two product webs, means to advance the pair of first color webs along parallel first paths, means to change direction 90 degrees and superpose said first color webs in one lane of a two lane second path, means to slit, and advance a pair of second color product webs along parallel first paths spaced from the first color webs, turn and place of both second color product webs in a second lane of the two lane second path, means to advance webs in said two lanes of the second path and simultaneously emboss at least two superposed juxtaposed webs, means to separate and advance the bottom pair of juxtaposed webs to a first juxtaposed pair of longitudinal folding plates and advance one of said bottom webs to one side of a dual folder means to separate and advance the next bottom pair of juxtaposed webs to a pair of side by side longitudinal folding plates and advance one of said pair to the other side of a dual folder, means to cut and transversely fold segments in each side of a dual folder and superpose said folded segments from each folder for vertical delivery between belts as a pair of alternately colored napkins in each delivery lane from said dual folder, means to pack consecutive pairs into a stack containing alternating color mixed napkins.

2. The apparatus of claim 1 wherein said plurality of unwind stands are arranged on the same side of the second path.

3. The apparatus of claim 1 wherein means to turn webs 90 degrees includes parallel turning bar surfaces to turn and superpose exiting product webs of the same color in the same lane of the second path, said turning bars for a first color parallel to, and vertically spaced from, turning bars for the second color.

4. The apparatus of claim 3 wherein means to turn webs 90 degrees includes placement of similar colored webs in different lanes of the second path.

5. The apparatus of cliam 3 wherein at least one of said turning bars for like-colored webs and is vertically separated from another turning bar that accepts and turns two other like-colored webs.

6. The apparatus of claim 1 including means wherein juxtaposed product webs advancing in parallel lanes are center slit by two water jet cutters and trabsversely spaced before embossing.

7. The apparatus of claim 6 including means wherein said spaced webs are embossed and said webs are subsequently trimmed along both outside edges.

8. The apparatus of claim 1 including means wherein juxtaposed webs are trimmed along both side edges, and means to longitudinally fold the spaced apart juxtaposed webs.

9. The apparatus of claim 8 including means for transverse sliding adjustment of the folding plate.

10. The apparatus of claim 1 wherein the framework of said web turning means includes a web opening that exceeds three product widths for at least one of said first and second web paths.

11. The apparatus of claim 1 wherein the turning bars extend beyond side margins of the incoming and exiting webs advancing along firsr and second paths.

12. The apparatus of claim 1 wherein a plurality of unwind stands and monochromatic supply rolls of different colors are located on opposite sides of said second path and wherin said means to turn webs includes parallel turning bar surfaces to turn and superpose exiting product webs of the same color in one lane of the second path, said turning bars for a first color vertically spaced from, and perpendicular to, turning bars for a second color.

13. The apparatus of claim 1 wherein at least two of said turning bar means are spaced, parallel and perpendicular from other turning bars that are spaced and parallel.

14. The apparatus of claim 1 uncluding means to unwind four supply roll, slit into eight product webs, turn product webs 90 degrees, emboss the third and fourth juxtaposed web pairs and advance them for folding over third and fourth folding plate pairs respectively before transversely folding in respective sides of a dual folding apparatus.

15. The apparatus of claim 1 wherein a plurality of stands includes means to unwind monochromatic rolls each of a first and second color for color mixing and delivery in two lanes of a foul lane delivery system from a dual folder.

16. In a method of procesing staacks having a plurality of color sequences including the steps of:

unwinding a plurality of monocheomatic supply roll pairs each having a different color and a width of two product webs, slitting each supply roll into two product webs, advancing said like colored product webs along a first path, turning said product webs 90 degrees and advancing them to one of two parallel lanes in the seond path, embossing at last two superposed juxtaposed product webs, separating each bottom web pair of juxtaposed webs and advancing said web pair for folding over side by side foldng plates advancing one web of said juxtaposed bottom webs to one side of a dual folder for transverse folding, advancing the other web of said juxtaposed bottom webs to the other side of a dual folder, cutting and transverse folding segments from said webs in each side of the dual folder, superposing simultaneously produced napkins from each side of the dual folder, advancing said superposed napkins in vertical delivery belts, delivering said napkins as a pair of differently colored anpkins, packing said differently colored napkin pairs as a stack in delivery channels for transfer to packaging.

* * * * *